US010759194B2

(12) United States Patent
Izawa et al.

(10) Patent No.: US 10,759,194 B2
(45) Date of Patent: Sep. 1, 2020

(54) DRYING DEVICE AND INK-JET PRINTING DEVICE EQUIPPED WITH THE SAME

(71) Applicant: MIYAKOSHI PRINTING MACHINERY CO., LTD., Narashino-shi, Chiba (JP)

(72) Inventors: Hideo Izawa, Narashino (JP); Kouichi Ooyama, Yokote (JP); Kazushige Sato, Yokote (JP); Hidetoshi Kon, Yokote (JP)

(73) Assignee: MIYAKOSHI PRINTING MACHINERY CO., LTD., Narashino-Shi, Chiba (JP)

( * ) Notice: Subject to any disclaimer, the term of this patent is extended or adjusted under 35 U.S.C. 154(b) by 26 days.

(21) Appl. No.: 16/173,517

(22) Filed: Oct. 29, 2018

(65) Prior Publication Data

US 2020/0031139 A1 Jan. 30, 2020

(30) Foreign Application Priority Data

Jul. 25, 2018 (JP) ..... 2018-139836

(51) Int. Cl.
*B41J 11/00* (2006.01)
*B41F 23/04* (2006.01)

(52) U.S. Cl.
CPC ..... *B41J 11/002* (2013.01); *B41F 23/042* (2013.01); *B41F 23/0459* (2013.01)

(58) Field of Classification Search
CPC ..... B41J 11/002; B41J 11/0015; B41J 2/2114; B41M 7/009; B41F 23/042;
(Continued)

(56) References Cited

U.S. PATENT DOCUMENTS 6,634,115 B2 * 10/2003 Gundel et al. ..... F26B 19/00
2012/0206527 A1 8/2012 Leighton et al.
(Continued)

FOREIGN PATENT DOCUMENTS

EP 3 093 148 A1 11/2016
JP 2012-116019 A 6/2012
(Continued)

OTHER PUBLICATIONS

European Search Report issued in Appln. No. 182030213 dated May 14, 2019 (9 pages).

*Primary Examiner* — Juanita D Jackson
(74) *Attorney, Agent, or Firm* — Flynn Thiel, P.C.

(57) ABSTRACT

A drying device H is provided with: a first heating roller part 10 and a second heating roller part 20 that guide a printed object X and are capable of heating the printed object X; a first heating part 11 that is formed so as to be opposed to the outer circumferential surface of the first heating roller part 10 and a second heating part 21 that is formed so as to be opposed to the outer circumferential surface of the second heating roller part 20, wherein after the printed object X has been guided to the first heating roller part 10 on the upstream side, it is guided to the second heating roller part 20 on the downstream side, with the setting temperature of the second heating roller part 20 being made higher than the setting temperature of the first heating roller part 10, and an ink-jet printing device I equipped with such a heating device.

8 Claims, 10 Drawing Sheets

(58) Field of Classification Search
CPC ..... B41F 23/0459; B41F 23/0436; B41F 23/0466; B41F 23/0456; B41F 23/0423
See application file for complete search history.

(56) References Cited

U.S. PATENT DOCUMENTS

| | | | | |
|---|---|---|---|---|
| 2015/0174924 | A1* | 6/2015 | Fuchioka et al. .... | B41J 11/0015 |
| 2017/0334217 | A1 | 11/2017 | Yoshinuma et al. | |

FOREIGN PATENT DOCUMENTS

| | | | |
|---|---|---|---|
| JP | 2013-018247 | A | 1/2013 |
| JP | 2016-107549 | A | 6/2016 |

* cited by examiner

DRYING DEVICE AND INK-JET PRINTING DEVICE EQUIPPED WITH THE SAME

TECHNICAL FIELD

The present invention relates to a drying device and an ink-jet printing device equipped with the same, and more specifically, concerns a drying device for drying a printed object printed by a printing part and an ink-jet printing device equipped with the same.

BACKGROUND ART

A printing device for carrying out printing on a printing object, such as paper, film, cloth or the like, has been known.

In general, such printing is carried out by applying an ink containing a coloring agent and an aqueous solvent onto a printing object so that a printed object is formed. For this reason, the printed object immediately after the printing process is in a wet state containing the aqueous solvent, and the corresponding aqueous solvent needs to be removed from the printed object.

In the printed object immediately after the printing process from which the aqueous solvent needs to be removed as described above, when much time is required for removing the aqueous solvent, bleeding of ink onto the printing object due to insufficient drying of ink, flocculation of ink, mixed color with an ink having another color, retransferring to the printing object caused by an ink transferring process from a contact member to the printing surface and the like tend to occur, thereby causing a problem of degradation in image quality. Therefore, as the printing device, such a printing device provided with a drying device has been developed so as to dry the printed object immediately after the printing process.

For example, an ink-jet recording device (for example, see Patent Literature 1), which is an ink-jet recording device capable of continuously recording on the two surfaces of a web, and provided with a plurality of recording heads installed therein, a drying device for drying the web on which a recording was made by the recording head and guide rollers for guiding the web, and another ink-jet recording device (for example, see Patent Literature 2), which is provided with a line head disposed on the recording surface side of a web, guide rollers for guiding the web, a suction mechanism disposed on the non-recording surface side of the web, and a drying device for drying the web on which the recording was made by the recording head, have been known.

Moreover, a method for constituting a liquid coating device (for example, see Patent Literature 3), which includes steps of providing a drying unit including a liquid coating unit having a first transporting part for transporting a medium and a liquid coating part for applying a liquid onto the medium transported by the first transporting device, a second transporting part for transporting the medium onto which the liquid is applied by the liquid coating part and a drying unit for drying the liquid applied onto the medium, with the drying unit being designed so that by controlling the second transporting part, a tension to be applied to the medium inside the drying unit can be controlled, has been known in which in the case when a transporting path of a medium is formed between the liquid coating unit and the drying unit by connecting the liquid coating unit and the drying unit, or in the case when a transporting path of a medium is formed between the two drying units by connecting the two drying units, an adjusting part between the connected two units is provided so that the transporting operation of the medium in one of the units and the transporting operation of the medium in the other unit are independently controlled, and the number of the drying units to be provided in the liquid coating device is determined depending on the kinds of media to be transported.

CITATION LIST

Patent Literature

PTL 1: Japanese Patent Application Laid-Open No. 2012-116019

PTL 2: Japanese Patent Application Laid-Open No. 2013-18247

PTL 3: Japanese Patent Application Laid-Open No. 2016-107549

SUMMARY OF INVENTION

Technical Problem

However, in the case of a drying machine installed in the ink-jet printing device described in Patent Literatures 1 and 2, since the drying time is comparatively short, it is necessary to make the setting temperature of the drying machine extremely high in order to sufficiently dry the printed object.

Moreover, in the case when the setting temperature of the drying machine is made extremely high, although the printed object is dried sufficiently, the temperature of the printed object is raised abruptly, with the result that the printed object itself might be curled, or wrinkles and cockling might occur in the printed object. Additionally, the cockling refers to a state in which the printed object is curved like waves.

Furthermore, in the liquid coating device described in Patent Literature 3, two drying units are installed; however, since the transporting speed is made two times faster correspondingly, it is not possible to suppress the abrupt temperature rise of the printed object as a result. Therefore, it cannot be said that it becomes possible to sufficiently suppress curling of the printed object itself or wrinkles and cockling from occurring in the printed object.

In view of the above-mentioned circumstances, the present invention has been devised, and its object is to provide a drying device capable of drying the printed object as well as sufficiently suppressing curling of the printed object itself or wrinkles and cockling from occurring in the printed object.

Solution to Problems

As a result of earnest study made by the present inventors, etc. in view of solving the above-mentioned problems, they have found that upon drying a printed object, it is necessary to take two stages of processes, that is, sufficiently heating the wet printed object and then applying sufficient evaporation energy to the aqueous solvent.

Moreover, they have found that by forming a configuration in which the printed object is heated step by step by using a first heating roller part and a first heating part, as well as a second heating roller part and a second heating part, the above-mentioned problems can be solved so that the present invention has been completed.

The present invention, which relates to a drying device which (1), while transporting a long-sized printed object to which an ink was applied by a printing part, the printed object is dried, is provided with a first heating roller part and a second heating roller part that guide the printed object and can also heat the printed object, a first heating part installed so as to be opposed to the outer circumferential surface of the first heating roller part, and a second heating part installed so as to be opposed to the outer circumferential surface of the second heating roller part, and the resulting drying device is designed so that after the printed object has been guided to the first heating roller part on the upstream side, it is guided to the second heating roller part on the downstream side, with the setting temperature of the second heating roller part being made higher than the setting temperature of the first heating roller part.

The present invention, which relates to the drying device described in the above-mentioned (1) in which (2) the first heating part is constituted by a plurality of first hot air blowing devices that are installed side by side along a circumferential direction of the first heating roller part, and the second heating part is constituted by a plurality of second hot air blowing devices that are installed side by side along a circumferential direction of the second heating roller part, and gaps are formed between the printing surface of the printed object and the first hot air blowing devices as well as between the printing surface of the printed object and the second hot air blowing devices so that the first hot air blowing devices and the second hot air blowing devices are respectively allowed to blow hot air toward the printing surface of the printed object.

The present invention relates to the drying device described in the above-mentioned (2) in which (3) a gap is formed between the mutually adjacent first hot air blowing devices and a gap is formed between the mutually adjacent second hot air blowing devices.

The present invention relates to the drying device described in any one of the above-mentioned (1) to (3) which is further provided with (4) an auxiliary heating part that is formed on an upper stream side than a position at which the rear surface of the printed object is made to contact with the first heating roller part, and the auxiliary heating part is constituted by auxiliary hot air blowing devices installed along the transporting path of the printed object, with a gap being formed between the printing surface of the printed object and the auxiliary hot air blowing devices, so that the auxiliary hot air blowing devices are capable of blowing the hot air toward the printing surface of the printed object.

The present invention relates to the drying device described in any one of the above-mentioned (1) to (4) in which (5) the second heating roller part and the second heating part are housed in a chamber provided with an exhaust opening.

The present invention relates to the drying device described in the above-mentioned (5) which is further provided with (6) a quick cooling roller that guides the printed object and is also capable of cooling the printed object, and the quick cooling roller is disposed closely to the second heating roller part so that the printed object ejected out of the chamber is directly guided from the second heating roller part to the quick cooling roller.

The present invention relates to the drying device described in the above-mentioned (6) which is further provided with (7) a cooling roller that guides the printed object and is also capable of cooling the printed object, and the cooling roller is disposed on the downstream side of the quick cooling roller so that after the printed object has been guided to the quick cooling roller, it is further guided to the cooling roller.

The present invention relates to an ink-jet printing device that is provided with (8) a printing part which, while transporting a printing object, carries out a printing process on the printing object, and a drying device described in any one of the above-mentioned (1) to (7) which, while transporting a long-sized printed object that was printed by the printing part, dries the printed object, and the printing part is constituted by a plurality of ink-jet printing heads.

Advantageous Effects of Invention

In the drying device of the present invention, since the first heating roller part and the second heating roller part are installed, the drying time relative to the printed object to be transported can be made sufficiently longer.

Moreover, by heating the two sides of the printed object by using the first heating roller part and the first heating part as well as the second heating roller part and the second heating part, the printed object can be efficiently dried.

At this time, in the drying device of the present invention, since the setting temperature of the second heating roller part is higher than the setting temperature of the first heating roller part, the wet printed object is sufficiently heated by the first heating roller part and the first heating part whose setting temperatures are comparatively low, and to the aqueous solvent, a sufficient evaporation energy can be applied by the second heating roller part and the second heating part whose setting temperatures are comparatively high. Additionally, by adding sufficient evaporation energy thereto, the aqueous solvent is evaporated to be removed from the printed object.

In this manner, in the drying device of the present invention, since the wet printed object immediately after the printing process can be heated step by step, the printed object can be positively dried, and it becomes possible to sufficiently suppress curling of the printed object itself or wrinkles and cockling from occurring in the printed object.

In this case, the setting temperature of the first heating roller part is desirably made the boiling point or less of the aqueous solvent contained in the ink. That is, in the first heating roller part, heating of the printed object is more preferentially carried out in comparison with the evaporation of the aqueous solvent. Thus, it becomes possible to positively prevent the temperature of the printed object from being abruptly raised.

In the drying device of the present invention, since the plural first hot air blowing devices are installed side by side along the circumferential direction of the first heating roller part as the first heating part, and since the plural second hot air blowing devices are installed side by side along the circumferential direction of the second heating roller part as the second heating part, the hot air can be blown to the printed object without irregularities. Thus, the printed object is suppressed from having partial differences in the drying speed and can be more uniformly dried.

At this time, it is more desirable to set a gap between the adjacent first hot air blowing devices as well as between the adjacent second hot air blowing devices. In this case, the hot air blown toward the printed object can be released through the gap. Thus, since a convection current of the hot air blown thereto is generated, it is possible to prevent the hot air containing the aqueous solvent from being stagnated on the periphery of the printed object.

In the drying device of the present invention, since the auxiliary heating part constituted by an auxiliary hot air blowing device is further installed, the printing surface side of the printed object can be preliminarily heated before the printed object has been made to contact with the first heating roller part. Additionally, since an ink was applied to the printing surface side of the printed object, this side is inferior to the rear surface side in heating efficiency. For this reason, by preliminarily heating the printing surface side of the printed object, the entire printed object can be more uniformly dried more efficiently.

In the drying device of the present invention, since the second heating roller part and the second heating part are housed in the chamber provided with an exhaust opening, the evaporated aqueous solvent can be held inside the chamber and also exhausted from the exhaust opening of the chamber. Thus, it is possible to prevent the evaporated aqueous solvent from floating and re-adhering to the printed object, or from adhering to the drying device.

In the drying device in the present invention, since the quick cooling roller to be installed closely to the second heating roller part is provided, the printed object ejected outside the chamber is quickly cooled by the quick cooling roller to which it is directly guided from the second heating roller part; therefore, the evaporation of the aqueous solvent in the printed object is forcefully stopped. Thus, the evaporated aqueous solvent is suppressed from being discharged outside of the chamber.

In the drying device in the present invention, since the cooling roller disposed on the downstream side of the quick cooling roller is provided, the printed object can be sufficiently cooled.

Thus, in the case when the printed object is collected by winding-up or the like, it becomes possible to suppress the dimensional changes of the printed object at the time of winding-up as much as possible.

Moreover, in the case when, not limited by winding-up, a post-processing device is connected, less influences are given to the post-processing device.

Furthermore, by returning the temperature of the printed object to that prior to the drying process, another printing process can be carried out on the rear surface of the printed object.

Furthermore, troubles, such as an expansion of the roller on the downstream side, etc., can be suppressed.

In the ink-jet printing device of the present invention, since the above-mentioned drying device is installed, a printed object on which printing processes were carried out by a plurality of ink-jet printing heads can be dried immediately after the printing processes, and it also becomes possible to sufficiently suppress curling of the printed object itself or wrinkles and cockling from occurring in the printed object.

DESCRIPTION OF EMBODIMENTS

Figure 1:
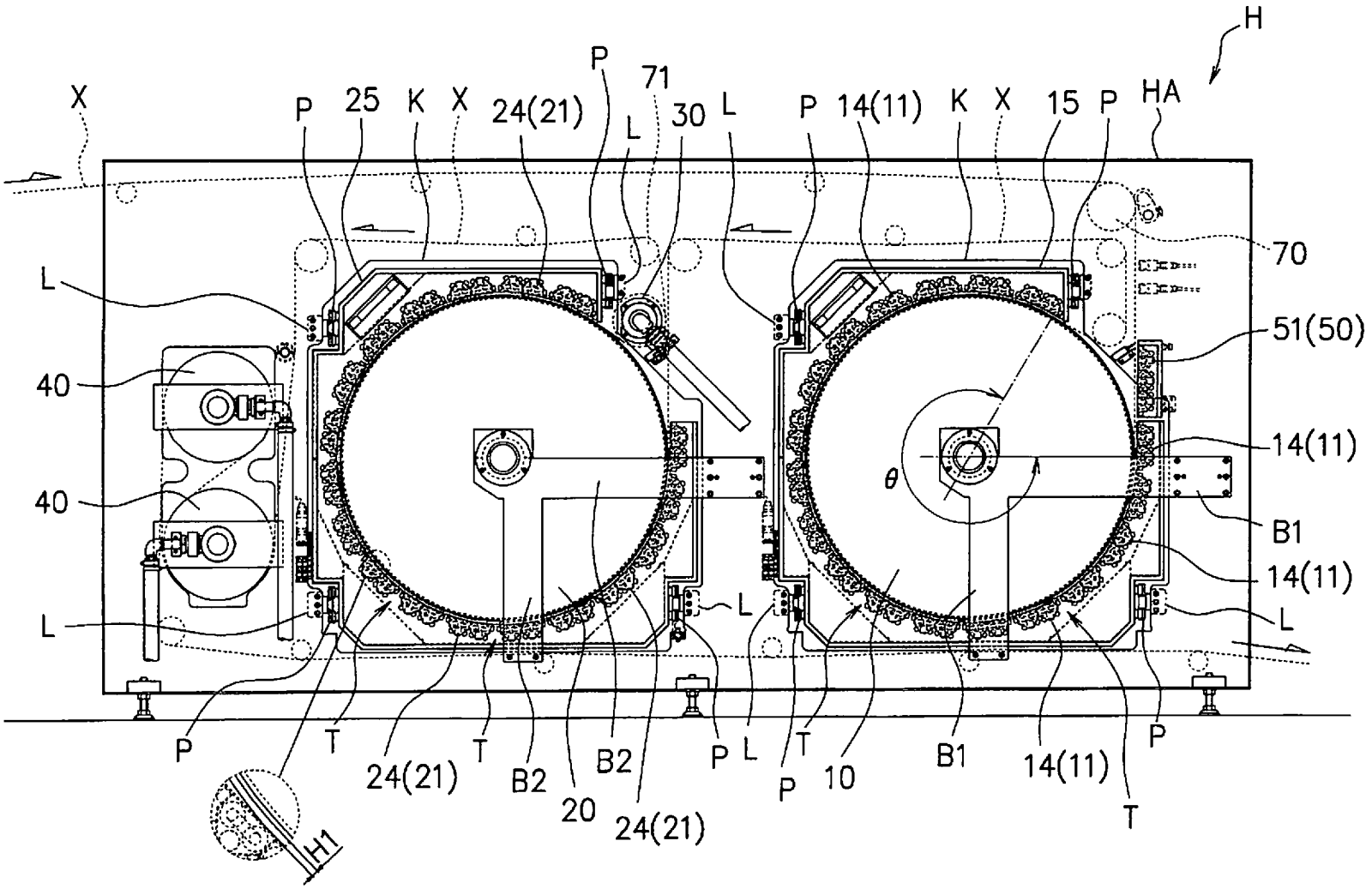
FIG. 1 is a perspective side view schematically showing one embodiment of a drying device in accordance with the present invention.

Referring to the Figures, the following description will discuss preferred embodiments of the present invention in detail. Additionally, in the drawings, the same components are indicated by the same reference numerals, and the overlapping descriptions will be omitted. Moreover, the positional relationship, such as upper, lower, left or right side, is based upon the positional relationship shown in the Figure, unless otherwise particularly specified. Furthermore, dimensional ratios of the Figures are not intended to be limited by the dimensional ratios shown in Figures.

First, an explanation will be given to a drying device in accordance with the present invention.

The drying device in accordance with the present invention is a device which dries a long-sized printed object corresponding to the printing object onto which an ink was applied by a printing part, while being transported.

The drying device may be used by being installed in a printing device, or may be continuously used by being installed in parallel with the printing device.

In this case, as the above-mentioned printing object, long-sized paper, film, cloth or the like may be adopted.

As the above-mentioned ink, although not particularly limited, an ink containing a colorant, such as dye, pigment or the like, an aqueous solvent and known additives to be added thereto on demand, may be used.

As the above-mentioned printing device, an ink-jet printing device, an offset printing device, a gravure printing device, a flexographic printing device, a screen printing device and the like may be adopted.

Additionally, in the present specification, "upstream side" means the upstream side in the transporting path of the printed object, and "downstream side" means the downstream side in the transporting path of the printed object. That is, the first heating roller part side is set to be the upstream side, and the second heating roller part side is set to be the downstream side.

Moreover, "printing surface" means a surface on the side where the ink for the printed object is applied, and "rear surface" means a surface on the side opposite to the printing surface.

Furthermore, "width direction" means a direction orthogonal to the transporting direction of the printed object.

FIG. 1 is a perspective side face view schematically showing one embodiment of a drying device in accordance with the present invention. Additionally, illustration of an exhaust opening 15*a* to be described later is omitted therefrom.

As shown in FIG. 1, a drying device H in accordance with the present embodiment is provided with: a heating roller part 10 (hereinafter, referred to as "first heating roller part") and a heating roller part 20 (hereinafter, referred to as "second heating roller part") that guide a printed object X and are capable of heating the printed object X; a heating part 11 (hereinafter, referred to as "first heating part") that is formed so as to be opposed to the outer circumferential surface of the first heating roller part 10 and a heating part 21 (hereinafter, referred to as "second heating part") that is formed so as to be opposed to the outer circumferential surface of the second heating roller part 20; a chamber 15 (hereinafter, referred to as "first chamber") in which the first heating roller part 10 and the first heating part 11 are housed; a chamber 25 (hereinafter, referred to as "second chamber") in which the second heating roller part 20 and the second heating part 21 are housed; an auxiliary heating part 50 installed on an upper stream side than a position where the rear surface of the printed object X is made in contact with the first heating roller part 10; a quick cooling roller 30 that guides the printed object X and is also capable of cooling the printed object X; and a cooling roller 40 that guides the printed object X and is also capable of cooling the printed object X.

In the drying device H, the printed object X onto which an ink was applied from a printing part, not shown, is successively guided by the first heating roller part 10, the second heating roller part 20, the quick cooling roller 30 and the cooling roller 40. Additionally, the printed object X that is dried after having been guided by the cooling roller 40 is guided, for example, to a collecting part, not shown, and collected in the collecting part by using a so-called, winding-up system or folding-up system. Alternatively, the printed object X that is dried after having been guided by the cooling roller 40 is guided, for example, to a printing part of another printing device so that the rear surface of the printed object is again printed.

In the drying device H, the printed object X is heated by the first heating roller part 10 and the first heating part 11 as well as the second heating roller part 20 and the second heating part 21, while being guided by these, and also cooled by the quick cooling roller 30 and the cooling roller 40.

In this manner, in the drying device H, since the printed object X is dried while being guided by the first heating roller part 10 and the second heating roller part 20, the drying time for the printed object X can be made sufficiently longer.

Moreover, since both of the two sides of the printed object X can be heated by the first heating roller part 10 and the first heating part 11 as well as the second heating roller part 20 and the second heating part 21, it becomes possible to efficiently dry the printed object X.

First, the printed object X to which the ink was applied is guided by guide rollers, and heated and dried by the auxiliary heating part 50.

In the drying device H, the auxiliary heating part 50 is formed on the printing surface side of the printed object X on an upper stream side than a position at which the rear surface of the printed object X is made in contact with the first heating roller part 10, along the printed object X.

In the drying device H, prior to the arrival of the printed object X with an ink applied thereto to the first heating roller part 10, the printing surface that is wetter than the rear surface of the printed object X is preliminarily heated by the auxiliary heating part 50. Thus, in the printed object X, differences in the drying speeds between the printing surface and the rear surface of the printed object X caused by the first heating roller part 10 and the first heating part 11 as well as the second heating roller part 20 and the second heating part 21 to be described later can be made smaller as much as possible. As a result, the printed object X as a whole can be more efficiently dried more uniformly.

The auxiliary heating part 50 is constituted by an auxiliary hot air blowing device 51 installed along the transporting path of the printed object X. Additionally, the auxiliary hot air blowing device 51 is supported by a frame, not shown, attached to a box part HA of the drying device H.

The auxiliary hot air blowing device 51 is allowed to blow hot air to the printed object X. That is, there is a gap between the printing surface of the printed object X and the auxiliary hot air blowing device 51 so that the auxiliary hot air blowing device 51 can blow hot air toward the printing surface of the printed object X.

The shortest distance between the printed object X and the auxiliary hot air blowing device 51 is desirably set from 5 mm to 10 mm, in the same manner as in the shortest distance H1 between the outer circumferential surface of the first heating roller part 10 and the first hot air blowing device 14, which will be described later.

As the auxiliary hot air blowing device 51, such a device similar to a thermostat or a thermocouple to be described later may be attached.

The setting temperature of the auxiliary hot air blowing device 51 is preferably set from 100 to 140° C.

Since the structure of the auxiliary hot air blowing device 51 is the same as the structure of a hot air blowing device 14 of the first heating part 11 to be described later, other detailed descriptions thereof will be omitted (see FIGS. 3(A), 3(B), 3(C) and 3(D)). Additionally, the auxiliary hot air blowing device 51 is constituted by three blowing units 14*a* (see FIG. 3(A)).

The printed object X that has passed through the auxiliary heating part 50 is guided by the corresponding first heating roller part 10 in a manner so as to wind around the outer circumferential surface of the first heating roller part 10. That is, the first heating roller part 10 is designed to guide the printed object X and also to heat the printed object X.

At this time, the winding angle θ of the printed object X relative to the heating roller part 10, that is, the angle θ made by a first line that is formed by connecting a point on the side face of the first heating roller part 10 at which the printed object X is first made in contact with the first heating roller part 10 to the center axis of the first heating roller part 10 and a second line that is formed by connecting a point at which the printed object X is last in contact with the first heating roller part 10 to the center axis of the first heating roller part 10 is preferably set to 180 degrees or more, and more preferably set to 270 degrees or more. In this case, since the drying time is made sufficiently longer, the printed object can be dried at a comparatively low temperature.

In the drying device H, the first heating roller part 10 has a hollow column shape whose outer circumferential surface is designed to be heated. For this reason, the printed object X is heated when made in contact with the outer circumferential surface of the first heating roller part 10. Additionally, in order to prevent a degradation in image quality of the printing surface due to frictional sliding of the printed object X thereon, the first heating roller part 10 is preferably disposed so as to be made in contact with the rear surface of the printed object X.

Figure 2:
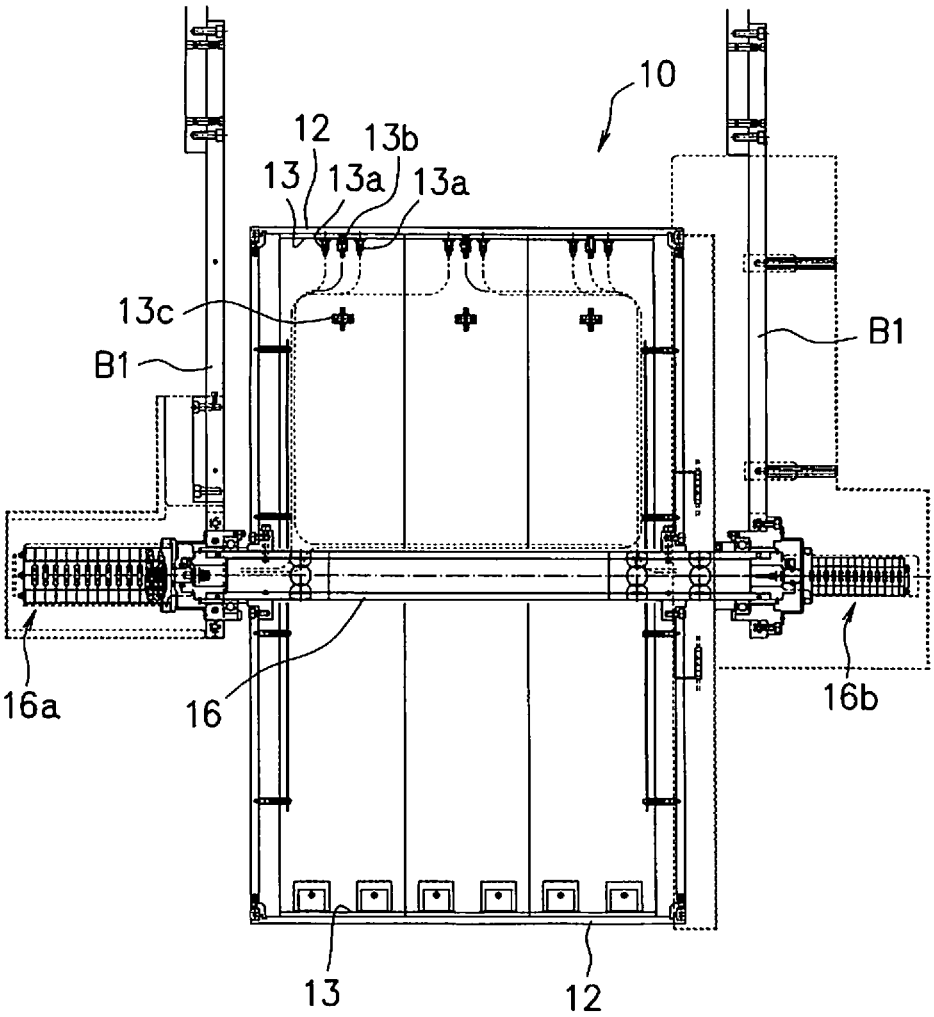
FIG. 2 is a horizontal cross-sectional view showing a first heating roller part of the drying device in accordance with the present embodiment.

FIG. 2 is a horizontal cross-sectional view showing the first heating roller part of the drying device in accordance with the present embodiment. Additionally, illustration of the first chamber 15 is omitted.

As shown in FIG. 2, the first heating roller part 10 is provided with a hollow column-shaped drum 12, a band heater 13 for heating the drum 12 and a shaft core 16 to which the two sides of the drum 12 are attached and fixed.

In the first heating roller part 10, the drum 12 is made of a metal such as aluminum or the like.

Moreover, the drum 12 has its outer circumferential surface subjected to irregularity machining, such as sand blasting, shot blasting, beads blasting or the like. Thus, when the rear surface of the printed object X and the outer circumferential surface of the first heating roller part 10 (drum 12) are in contact with each other, should there be air intruded into the gap between these, the air could be released from gaps caused by the surface with irregularities, and by further enhancing the grip, the adhesion onto the drum can also be improved. As a result, it is possible to suppress the drying efficiency of the printed object X from being lowered.

The band heater 13 has an annular shape, and is attached to the inside of the drum 12 in a manner so as to be set along the inner circumferential surface of the drum 12.

Moreover, three sets of the band heaters 13 are placed side by side relative to the width direction of the drum 12.

In each of the band heaters 13, a power source terminal 13*a*, a thermocouple 13*b* for measuring the temperature of the band heater 13 and a thermostat 13*c* for blocking the power supply to the heater upon the occurrence of an abnormal heating process are attached to the inner circumferential surface thereof.

Therefore, each band heater 13 has its temperature settable independently and also has its temperature adjustable.

Moreover, for example, in the case when the width of the printed object X is small, the power source for the band heater 13 that is not used can be turned OFF.

In this case, the setting temperature of the first heating roller part 10 is adjusted, for example, in a range from 80 to 120° C. The setting temperature is preferably adjusted to 100° C. or less. That is, in the first heating roller part 10, the heating process of the printed object is more preferentially carried out rather than the evaporation of the aqueous solvent. For this reason, the first heating roller part 10 carries out a heating process, while suppressing the evaporation of the aqueous solvent as much as possible so as not to abruptly raise the temperature of the printed object X.

The shaft core 16 is supported by brackets B1 through bearings, and each bracket B1 is attached to the box part HA of the drying device H through a frame. For this reason, the first heating roller part 10 is made to be freely rotatable relative to the bracket B1. Additionally, the first heating roller part 10 is rotated by a frictional force caused by the transporting of the printed object X to be consequently rotated together with the printed object X.

Moreover, to one end of the shaft core 16, a power source-use rotary connector 16*a* is attached, and to the other end thereof, a signal-use rotary connector 16*b* is attached.

Furthermore, each of the aforementioned power source terminals 13*a* is connected to the power source-use rotary connector 16*a* through a cable, and each of the aforementioned thermocouples 13*b* is connected to the signal-use rotary connector 16*b* through a cable.

Returning again to FIG. 1, in the drying device H, the first heating part 11 is installed so as to be opposed to the outer circumferential surface of the first heating roller part 10, with the printed object X interposed therebetween. That is, the first heating part 11 is installed with a fixed interval from the printing surface of the printed object X.

Therefore, the rear surface of the printed object X is heated by the first heating roller part 10, while the printing surface thereof is heated by the first heating part 11.

The first heating part 11 is constituted by a plurality of hot air blowing devices 14 (hereinafter, referred to as "first hot air blowing device") that are aligned side by side along the circumferential direction of the first heating roller part 10. Additionally, the plural first hot air blowing devices 14 corresponding to the first heating part 11 is supported by the first chamber 15.

The first hot air blowing device 14 is capable of blowing hot air to the printed object X. That is, there is a gap between the printing surface of the printed object X and the first hot air blowing device 14 so that the first hot air blowing device 14 can blow hot air toward the printing surface of the printed object X. Thus, hot air can be blown to the printed object X without irregularities. Moreover, the printed object X is suppressed from partially causing a difference in drying speeds and can be dried more uniformly.

In this case, the shortest distance H1 (see FIG. 1) between the outer circumferential surface of the first heating roller part 10 and the first hot air blowing device 14 is preferably set from 5 mm to 10 mm.

In the case when the shortest distance H1 is set to less than 5 mm, the printed object X might come into contact with the first hot air blowing device 14 (bottom plate 14*a*4) in comparison with a case where the shortest distance H1 is set within the above-mentioned range, and in the case when the shortest distance H1 exceeds 10 mm, the drying efficiency by the first hot air blowing device 14 tends to be abruptly lowered in comparison with the case where the shortest distance H1 is set within the above-mentioned range.

Figure 3A:
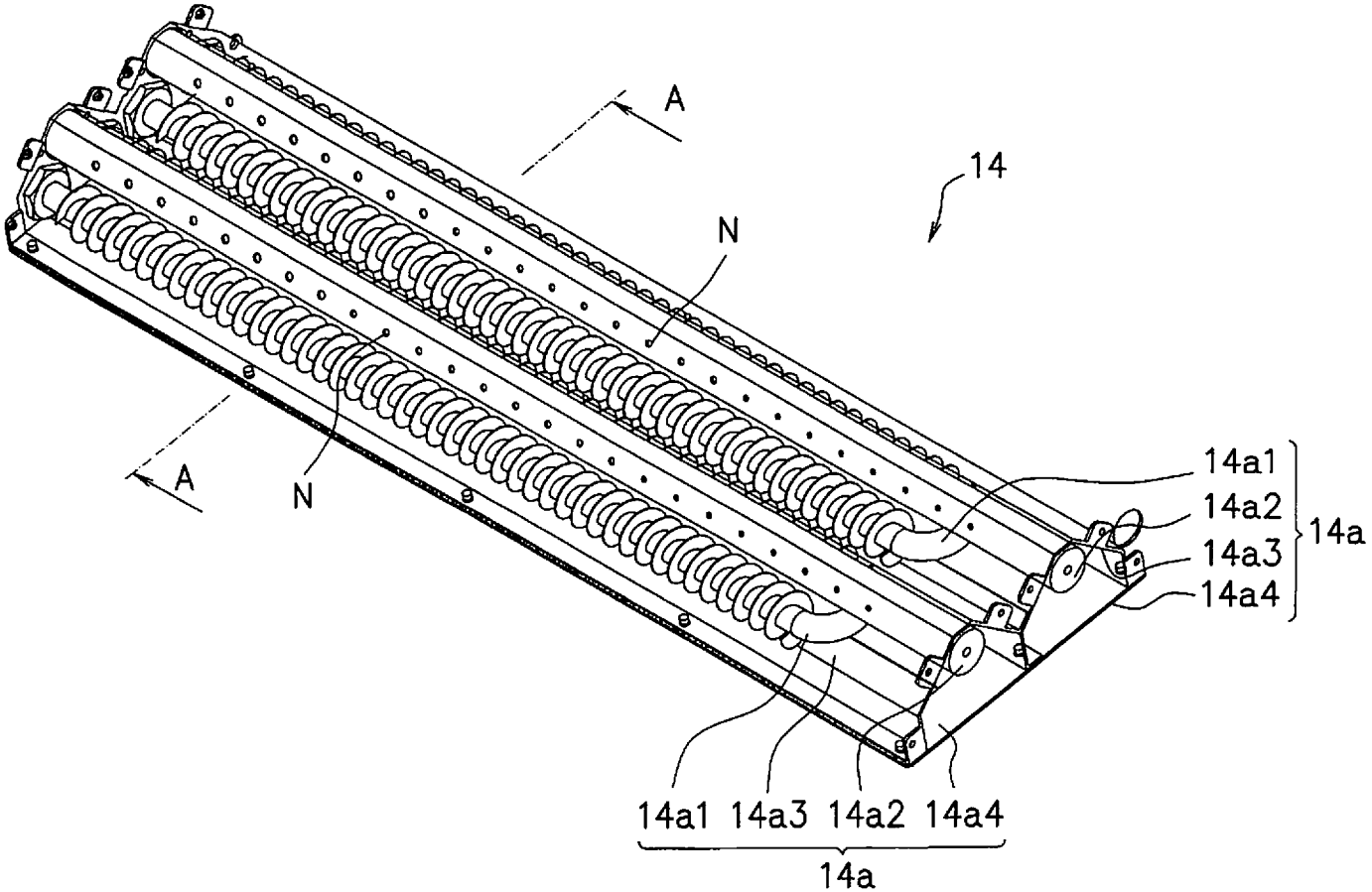
FIG. 3(A) is an oblique perspective view showing a first hot air blowing device of the drying device in accordance with the present embodiment.
Figure 3B:
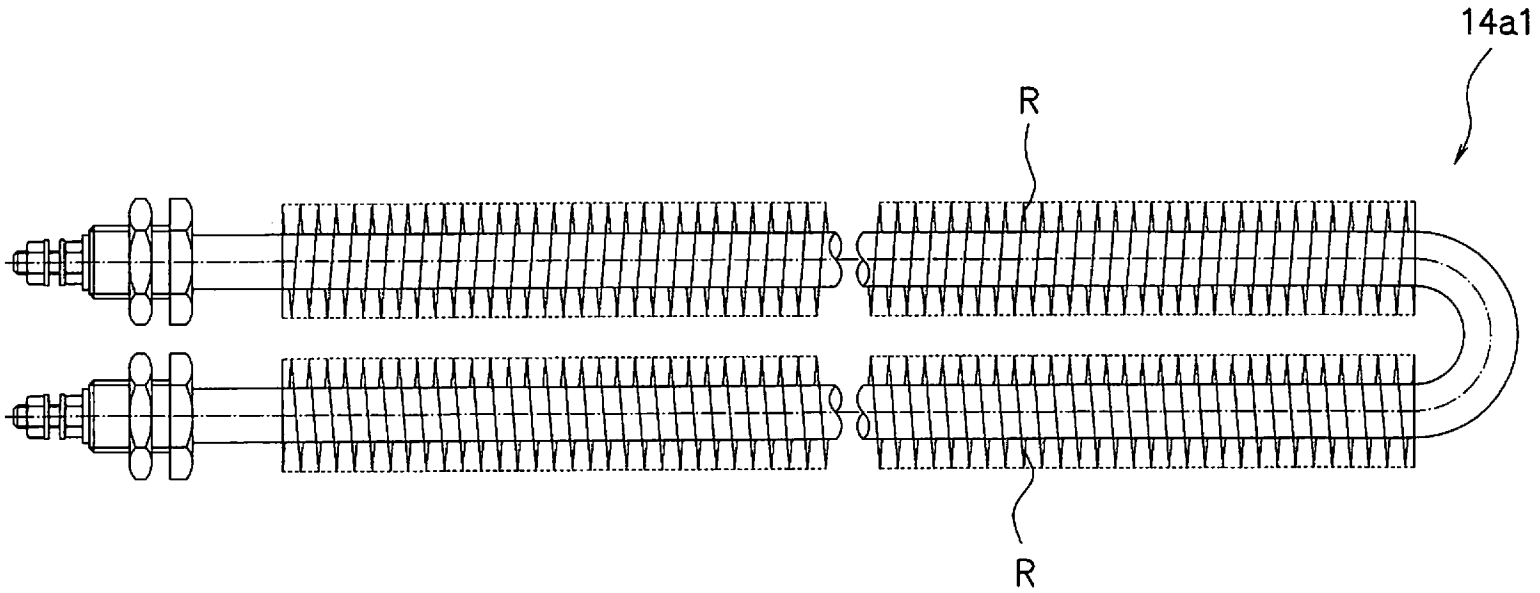
FIG. 3(B) is a top face view showing a sheath heater of the first hot air blowing device shown in FIG. 3(A).
Figure 3C:
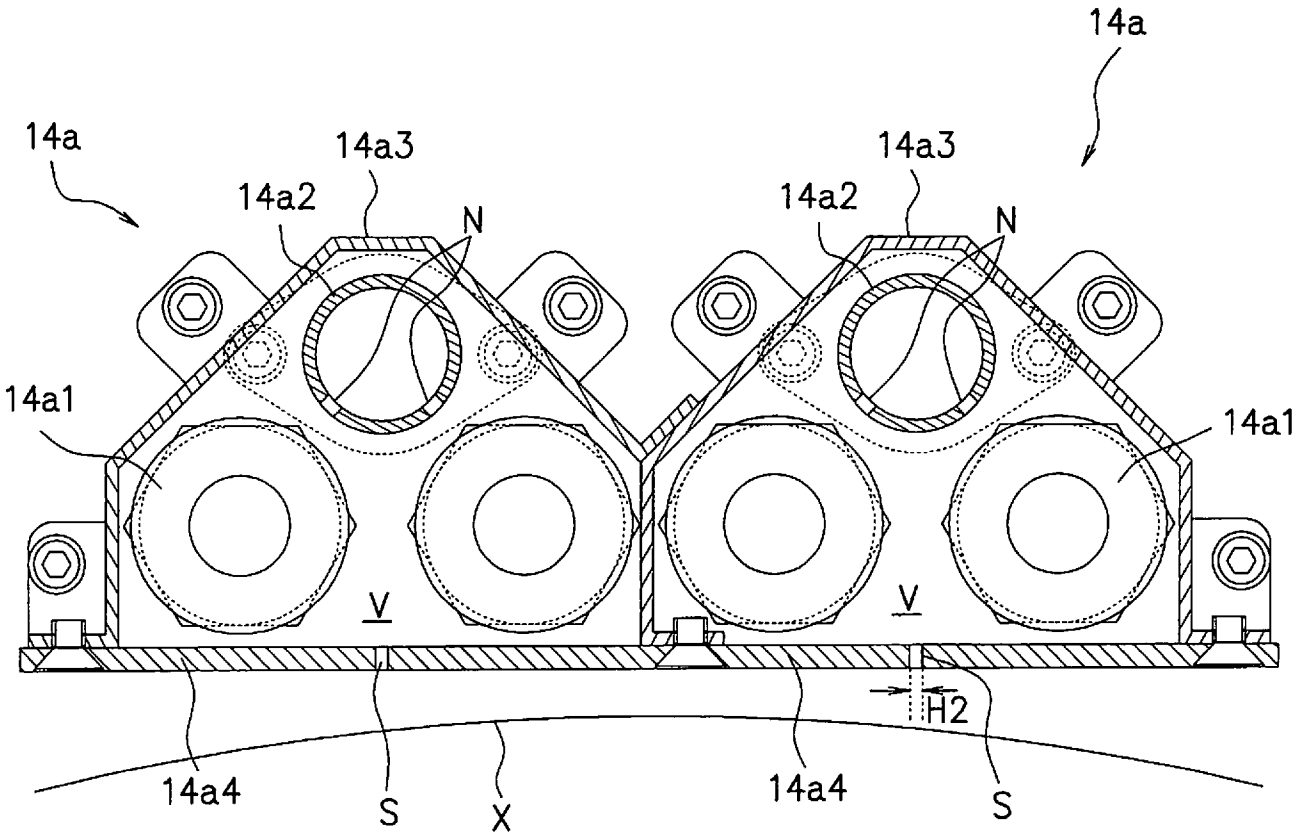
FIG. 3(C) is a cross-sectional view taken along line A-A of the first hot air blowing device shown in FIG. 3(A).
Figure 3D:
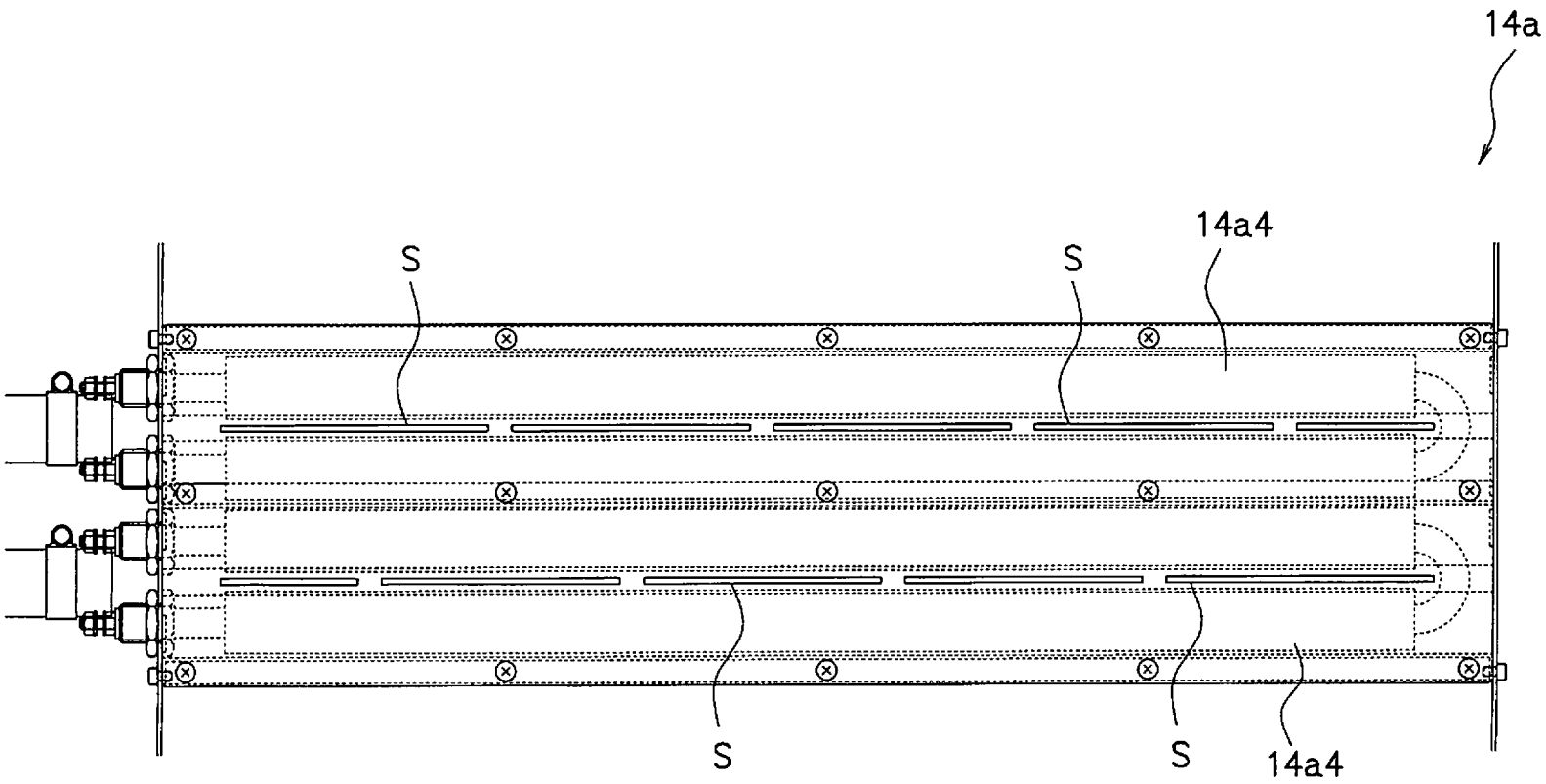
FIG. 3(D) is a bottom view showing the first hot air blowing device shown in FIG. 3(A).

FIG. 3(A) is an oblique perspective view showing the first hot air blowing device of the drying device in accordance with the present embodiment; FIG. 3(B) is a top view showing a sheath heater of the first hot air blowing device shown in FIG. 3(A); FIG. 3(C) is a cross-sectional view taken along line A-A of the first hot air blowing device shown in FIG. 3(A); and FIG. 3(D) is a bottom view of the first hot air blowing device shown in FIG. 3(A).

As shown in FIG. 3(A), the first hot air blowing device 14 is constituted by two blowing units 14*a*.

Moreover, each of the blowing units 14*a* has a hollow rectangular pillar shape that extends in a width direction of the first heating roller part 10 so as to be substantially made coincident with the width of the first heating roller part 10. For this reason, hot air to be blown from the first hot air blowing device 14 covers the entire width of the first heating roller part 10.

The blowing unit 14*a* is constituted by a bottom plate 14*a*4, a sheath heater 14*a*1 that is disposed on the bottom plate 14*a*4 so as to form a heating source, a nozzle pipe 14*a*2 capable of blowing air toward the sheath heater 14*a*1, and a heater cover 14*a*3 installed so as to cover the sheath heater 14*a*1 and the nozzle pipe 14*a*2.

As shown in FIG. 3(B), the sheath heater 14*a*1 is bent into a U-letter shape when seen from a top view and electrodes are formed on the ends of the two sides.

Since the sheath heater 14*a*1 has a spiral shaped rib part R, its surface area becomes larger. Thus, on the periphery of the sheath heater 14*a*1, air can be heated with a comparatively large area.

As shown in FIG. 3(C), since the sheath heater 14*a*1 is the above-mentioned U-letter shape, when cut along line A-A of FIG. 3(A), the heaters are installed one row by one row on the upstream side and the downstream side.

Moreover, the nozzle pipe 14*a*2 is formed on an upper side between the sheath heaters 14*a*1 on the two sides.

Furthermore, the nozzle pipe 14*a*2 is designed such that compressed air is allowed to flow through the inside thereof, and on the lower side of the nozzle pipe 14*a*2, there are a pair of nozzle holes N formed toward the sheath heaters 14*a*1 on the two sides. In this case, a plurality of the nozzle holes N are formed along the length direction of the nozzle pipe 14*a*2 (see FIG. 3(A)). Therefore, air blown from the nozzle holes N is heated by the sheath heaters 14*a*1.

At this time, the diameter of the nozzle hole N is gradually made smaller as it departs from the flow inlet of air of the nozzle pipe 14*a*2. That is, the air pressure of incoming air becomes greater at the recessed portion that is the furthest from the flow inlet of air of the nozzle pipe 14*a*2, while the air pressure of incoming air becomes smaller at a portion close to the flow inlet of air of the nozzle pipe 14*a*2; therefore, by making the diameter of the nozzle hole N smaller as it comes closer to the recessed portion, the blowing amount of air from each of the nozzle holes N can be made uniform.

In the blowing unit 14*a*, the sheath heater 14*a*1 and the nozzle pipe 14*a*2 are housed in a space V formed by a bottom plate 14*a*4 and the heater cover 14*a*3 coupled to the bottom plate 14*a*4. Therefore, the space V is filled with air heated by the sheath heater 14*a*1.

Moreover, a slit S is formed on the bottom plate 14*a*4 so that the heated air, that is, hot air, is blown onto the printed object X from the slit S.

Additionally, the width H2 of the slit S is preferably set from 0.5 mm to 1.0 mm from the viewpoint of the blowing width and the air pressure.

As shown in FIG. 3(D), in the blowing unit 14*a*, a plurality of the slits S are installed so as to extend along the length direction (width direction of the first heating roller part 10) of the bottom plate 14*a*4. Thus, hot air can be blown to the entire width of the first heating roller part 10.

Returning again to FIG. 1, in the first heating part 11, a gap T is formed between the mutual adjacent first hot air blowing devices 14. Thus, the hot air blown to the printed object X from the slit S of the first hot air blowing device 14 and evaporated aqueous solvent can be released outside through the gap T. As a result, since a convection current of the hot air blown thereto is generated, it is possible to prevent the hot air containing the aqueous solvent from being stagnated on the periphery of the printed object X.

Additionally, as the first hot air blowing device 14, such a device similar to the aforementioned thermostat or thermocouple may be installed.

Moreover, the setting temperature of the first hot air blowing device 14 is preferably set to the setting temperature or more of the first heating roller part 10, and more specifically, more preferably set to a temperature obtained by adding 0 to 20° C. to the setting temperature of the first heating roller part 10.

In the drying device H, the first heating roller part 10 and the first heating part 11 are housed in the first chamber 15.

The first chamber 15 has a box shape having holes corresponding to the drum 12 on the front face (surface side of the paper of FIG. 1) and the rear face (back side of the paper of FIG. 1), and is formed so as not to interfere with the first heating roller part 10 and the first heating part 11, and also so as to cover them.

Moreover, the first chamber 15 has openings at corner portions so as not to interfere with the transporting process of the printed object X.

In the drying device H, even if the aqueous solvent of the printed object X is evaporated by the heating process of the first heating roller part 10 and the first heating part 11, the evaporated solvent can be sufficiently enclosed inside the first chamber 15.

The first chamber 15 has sliding parts P respectively formed on the outer side faces on the upstream side and the downstream side, and is supported on rail parts L formed on the box part HA of the drying device through the sliding parts P.

Moreover, the rail parts L extend from the inside of the box part HA rearward (back side of the paper of FIG. 1) of the box part HA through cut-out parts K formed on the box part HA so as to be in parallel with the shaft core direction (width direction) of the first heating roller part 10. For this reason, the first chamber 15 is allowed to pass through the cut-out parts K from the inside of the box part HA along the rail parts L through the sliding parts P, and is made slidable rearward of the box part HA. Additionally, at this time, the hole of the front face of the first chamber 15 passes through the drum 12.

In the heating device H, by allowing the first chamber 15 to slide rearward of the box part HA, an advantage of easy maintenance can be obtained.

Moreover, the first chamber 15 has its inner wall face covered with a heat insulating material, not shown, having a heat insulating property in itself, such as glass wool or the like. For this reason, the first chamber 15 is allowed to exert a so-called heat shielding effect that suppresses heat generated by the first heating roller part 10 and the first heating part 11 from transmitting to the outside of the first chamber 15.

Figure 4:
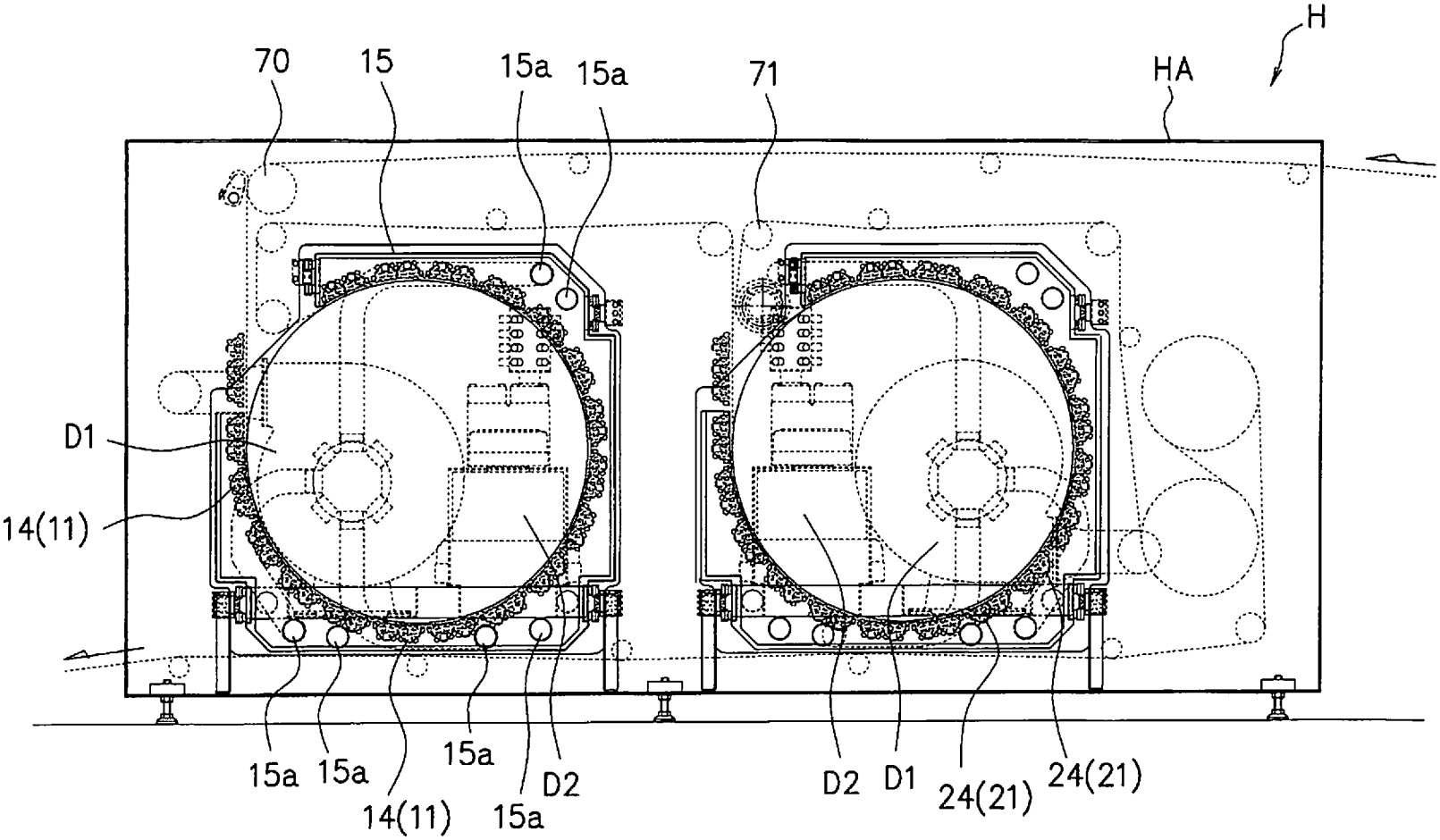
FIG. 4 is a perspective side view showing the drying device of FIG. 1 seen from an opposite side.

FIG. 4 is a perspective side view showing the drying device of FIG. 1 viewed from the opposite side. Moreover, in FIG. 4, illustration of a pipe coupled to the exhaust opening 15*a* is omitted.

As shown in FIG. 4, the first chamber 15 has a plurality of exhaust openings 15*a* formed on its side face. Moreover, each of the exhaust openings 15*a* is communicated with an exhaust-use air blower D1 disposed on the outside of the first chamber 15. Therefore, by operating the exhaust-use air blower D1, air inside the first chamber 15 can be exhausted from exhaust ducts, not shown, on the outside through the exhaust openings 15*a*. Thus, in the first chamber 15, even if the aqueous solvent is evaporated and floating, the aqueous solvent can be removed so that it becomes possible to prevent the floating aqueous solvent from re-adhering to the printed object X by dew condensation or from adhering to the inside of the drying device H to cause contamination.

Moreover, inside the first chamber 15, a supply-use air blower D2 for supplying air to the aforementioned first heating part 11 is disposed in parallel with the exhaust-use air blower D1. Additionally, a supply opening for supplying air to the first heating part 11 is also formed on the first chamber 15; however, illustration thereof is omitted because the position of the supply opening and the position of the first heating part 11 overlap with each other.

Returning again to FIG. 1, in the drying device H, the printed object X that has passed through the first heating roller part 10 on the upstream side is guided to the second heating roller part 20 on the downstream side through a plurality of guide rollers.

The second heating roller part 20 has a hollow column shape whose outer circumferential surface is designed to be heated. For this reason, the printed object X is heated when made in contact with the outer circumferential surface of the second heating roller part 20. Additionally, in order to prevent a degradation in image quality of the printing surface due to frictional sliding of the printed object X thereon, the second heating roller part 20 is preferably disposed so as to be in contact with the rear surface of the printed object X.

Additionally, the second heating roller part 20 is supported by brackets B2, and each of the brackets B2 is attached to the box part HA of the drying device H through a frame.

Moreover, since the structure of the second heating roller part 20 is the same as the structure of the aforementioned first heating roller part 10, the other detailed explanations thereof will be omitted (see FIG. 2).

In this case, the setting temperature of the second heating roller part 20 is made higher than the setting temperature of the first heating roller part 10. That is, in the second heating roller part 20, with respect to the printed object X sufficiently heated by the first heating roller part 10, the aqueous solvent is evaporated. For this reason, in the second heating roller part 20, the aqueous solvent is actively evaporated so that the printed object X is positively dried.

Additionally, the setting temperature of the second heating roller part 20 is preferably designed in a range from 100 to 140° C.

In the drying device H, the second heating part 21 is installed so as to be opposed to the outer circumferential surface of the second heating roller part 20, with the printed object X interposed therebetween. That is, the second heating part 21 is formed with a fixed interval from the printing surface of the printed object X.

Therefore, the printed object X has its rear surface heated by the second heating roller part 20 and also has its printing surface heated by the heating part 21.

The second heating part 21 is constituted by a plurality of hot air blowing devices 24 (hereinafter, referred to as "second hot air blowing device") that are installed side by side along a circumferential direction of the second heating roller part. Additionally, the second hot air blowing device 24 is supported by the second chamber 25.

The second hot air blowing device 24 is capable of blowing hot air toward the printed object X. That is, there is a gap between the printing surface of the printed object X and the second hot air blowing device 24 so that the second hot air blowing device 24 is capable of blowing hot air toward the printing surface of the printed object X. Thus, hot air can be blown to the printed object X without irregularities. Moreover, the printed object X is suppressed from having partial differences in the drying speed and can be more uniformly dried.

In the second heating part 21, a gap T is formed between mutually adjacent second hot air blowing devices 24. Thus, the hot air blown toward the printed object X through the slit S of the second hot air blowing devices 24 can be released outside from the gap T. As a result, since a convection current of the hot air blown thereto is generated so that it is possible to prevent the hot air containing the aqueous solvent from being stagnated on the periphery of the printed object X.

The shortest distance between the outer circumferential surface of the second heating roller part 20 and the second hot air blowing devices 24 is preferably set from 5 mm to 10 mm, in the same manner as in the shortest distance H1 between the outer circumferential surface of the above-mentioned first heating roller part 10 and the first hot air blowing device 14.

As the second hot air blowing device 24, a device similar to the aforementioned thermostat or thermocouple, may be attached.

The setting temperature of the second hot air blowing device 24 is preferably set to the setting temperature or more of the second heating roller part 20, and more specifically, it is more preferably set to a temperature obtained by adding 0 to 20° C. to the setting temperature of the second heating roller part 20.

Additionally, since the structure of the second hot air blowing device 24 is the same as the first hot air blowing device 14 of the aforementioned first heating part 11, the other detailed explanations thereof will be omitted (see FIG. 3(A), FIG. 3(B), FIG. 3(C) and FIG. 3(D)).

In the drying device H, the second heating roller part 20 and the second heating part 21 are housed in the second chamber 25 (chamber).

The second chamber 25 has a box shape having holes corresponding to the drum 12 on the front face (surface side of the paper of FIG. 1) and the rear face (back side of the paper of FIG. 1), and is formed so as not to interfere with the second heating roller part 20 and the second heating part 21, and also so as to cover these.

Moreover, the second chamber 25 has openings at corner portions so as not to interfere with the transporting process of the printed object X.

In the drying device H, even if the aqueous solvent of the printed object X is evaporated by the heating process of the second heating roller part 20 and the second heating part 21, the evaporated solvent can be sufficiently enclosed inside the second chamber 25.

The second chamber 25 has sliding parts P respectively formed on the outer side faces on the upstream side and the downstream side, and is supported on rail parts L formed on the box part HA of the drying device through the sliding parts P.

Moreover, the rail parts L extend from the inside of the box part HA rearward (back side of the paper of FIG. 1) of the box part HA through cut-out parts K formed on the box part HA so as to be in parallel with the shaft core direction (width direction) of the second heating roller part 20. For this reason, the second chamber 25 is allowed to pass through the cut-out parts K from the inside of the box part HA along the rail parts L through the sliding parts P, and is made slidable rearward of the box part HA. Additionally, at this time, the hole of the front face of the second chamber 25 passes through the drum 12.

In the heating device H, by allowing the second chamber 25 to slide rearward of the box part HA, an advantage of easy maintenance can be obtained.

Moreover, the second chamber 25 has its inner wall face covered with a heat insulating material, not shown, having a heat insulating property in itself, such as glass wool or the like. For this reason, the second chamber 25 is allowed to exert a so-called heat shielding effect that suppresses the heat generated by the second heating roller part 20 and the second heating part 21 from transmitting to the outside of the second chamber 25.

The second chamber 25 has a plurality of exhaust openings 15*a* formed on its side face in the same manner as in the aforementioned first chamber 15. Moreover, each of the exhaust openings 15*a* is communicated with an exhaust-use air blower D1 disposed on the outside of the second chamber 25 in the same manner as in the aforementioned first chamber 15. Therefore, by operating the exhaust-use air blower D1, air inside the second chamber 25 can be exhausted from exhaust ducts, not shown, on the outside through the exhaust openings 15*a*. Thus, in the second chamber 25, even if the aqueous solvent is evaporated and floating, the aqueous solvent can be removed so that it becomes possible to prevent, for example, the floating aqueous solvent from re-adhering to the printed object X by dew condensation or from adhering to the inside of the drying device H to cause contamination.

Moreover, inside the second chamber 25, a supply-use air blower D2 for supplying air to the aforementioned second heating part 21 is disposed in parallel with the exhaust-use air blower D1. Additionally, a supply opening for supplying air to the second heating part 21 is also formed on the second chamber 25; however, illustration thereof is omitted because the position of the supply opening and the position of the second heating part 21 are overlapped with each other.

In the drying device H, the printed object X is directly guided from the second heating roller part 20 to the quick cooling roller 30. That is, the printed object X guided to the second heating roller part 20 is designed to be guided to the quick cooling roller 30 immediately after having been ejected outside of the second chamber 25.

At this time, the printed object X is abruptly cooled by the quick cooling roller from a state in which it has been heated by the second heating roller part 20 and the second heating part 24. Thus, since the evaporation of the aqueous solvent in the printed object X is forcefully stopped, the evaporated aqueous solvent is prevented from being released out of the second chamber 25.

The quick cooling roller 30 has a hollow column shape whose outer circumferential surface is designed to be cooled. Therefore, the printed object X is cooled by being made to contact with the outer circumferential surface of the quick cooling roller 30. Additionally, the quick cooling roller 30 is preferably disposed so as to make the printing surface containing more of the aqueous solvent in contact therewith.

Additionally, the quick cooling roller 30 is supported by a frame attached to the box part HA of the drying device H.

Figure 5:
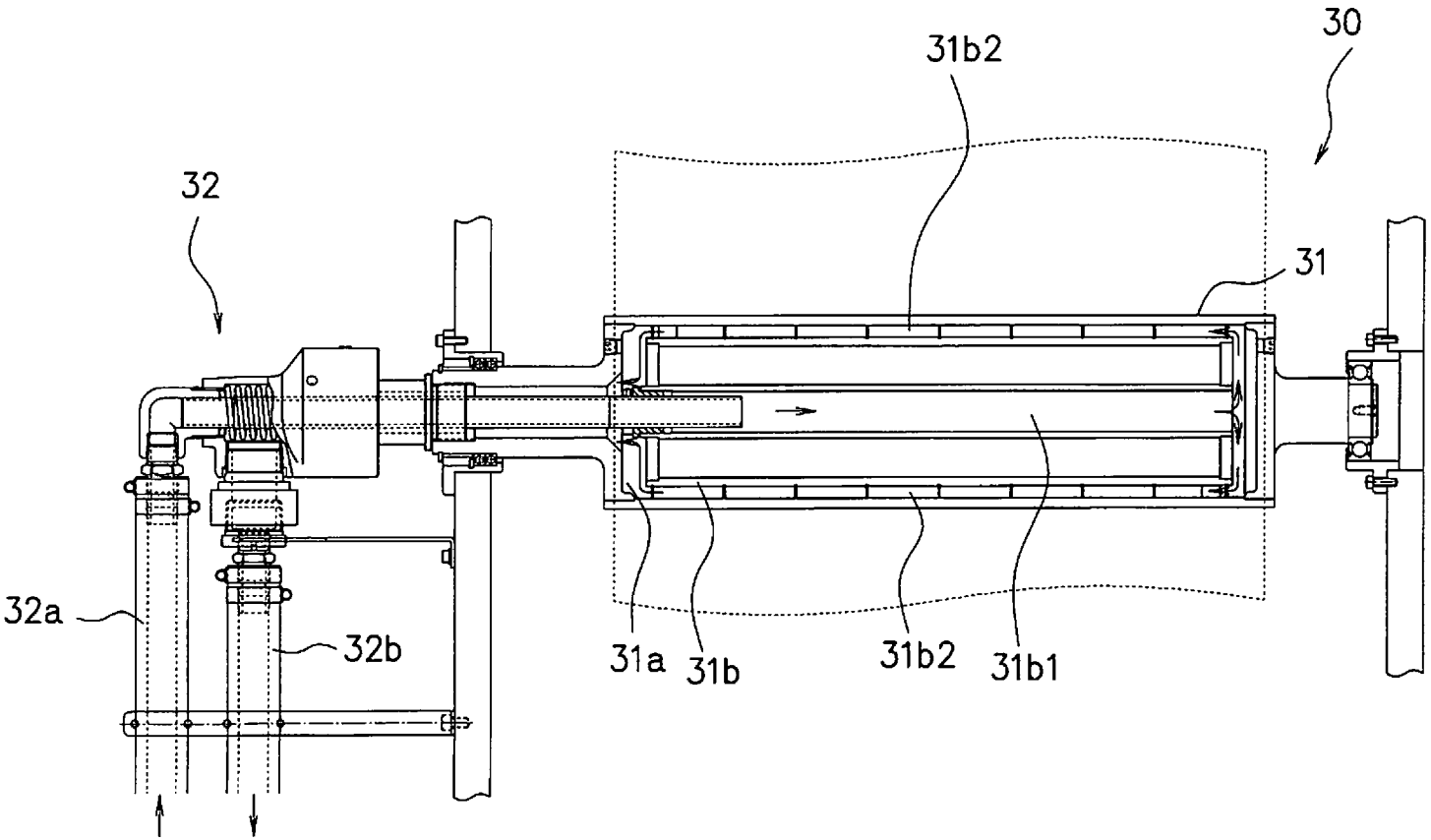
FIG. 5 is a vertical cross-sectional view taken along a width direction of a quick cooling roller of the drying device in accordance with the present embodiment.

FIG. 5 is a vertical cross-sectional view taken by cutting the quick cooling roller of the drying device in the width direction in accordance with the present embodiment.

As shown in FIG. 5, the quick cooling roller 30 is provided with a hollow column-shaped drum 31, a cylinder part 31*b* built in a hollow part 31*a* of the drum 31, a rotary joint 32 attached to one end of the drum 31 and an outgoing pipe 32*a* as well as a return pipe 32*b* attached to the rotary joint 32.

In the quick cooling roller 30, the hollow part 31*a* of the drum 31, the rotary joint 32 and the inside of the outgoing pipe 32*a* and the return pipe 32*b* are communicated with one another.

In the quick cooling roller 30, cooling water is allowed to flow into the drum 31 through the rotary joint 32.

More specifically, in the quick cooling roller 30, the cooling water is allowed to flow into an inside flow path 31*b*1 of the cylinder part 31*b* through the rotary joint 32 from the outgoing pipe 32*a*, and when the cooling water collides with the other end of the drum 31, it is guided to an outside flow path 31*b*2 of the cylinder part 31*b*, and from the outside flow path 31*b*2, it is allowed to flow out to the return pipe 32*b* through the rotary joint 32. Thus, the quick cooling roller 30 can be sufficiently cooled.

In the drying device H, the printed object X is guided to the cooling roller 40 on the downstream side from the quick cooling roller 30 through a plurality of guide rollers.

A pair of the cooling rollers 40 are installed in the vertical direction. Each of the cooling rollers 40 has a hollow column shape, and its outer circumferential surface is designed to be cooled. For this reason, the printed object X is further cooled when made to contact with the outer circumferential surface of the cooling roller 40.

Additionally, the cooling roller 40 is supported by a frame attached to the box part HA of the drying device H.

Figure 6:
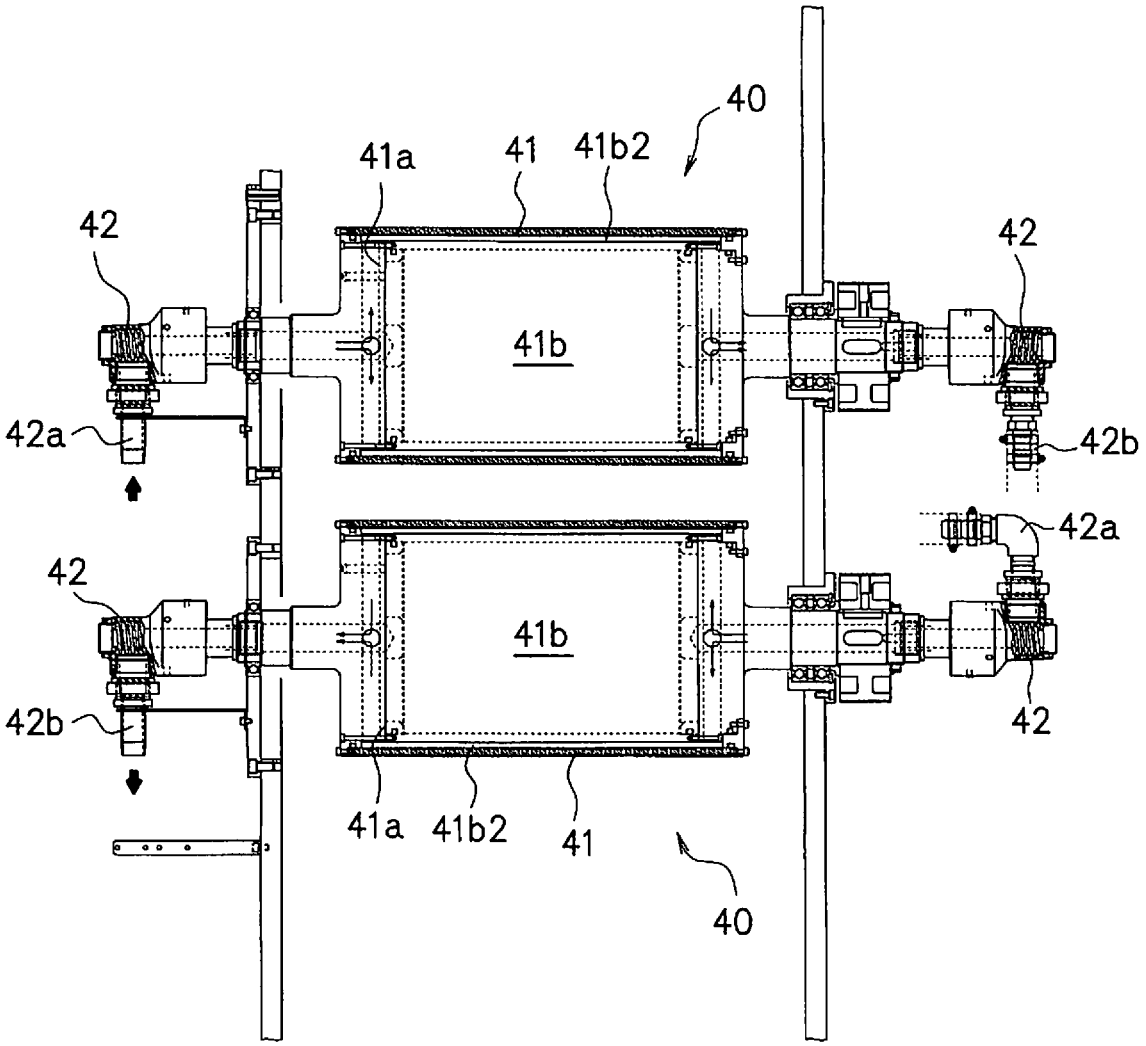
FIG. 6 is a vertical cross-sectional view taken along a width direction of a cooling roller of the drying device in accordance with the present embodiment.

FIG. 6 is a vertical cross-sectional view taken by cutting the cooling roller of the drying device in the width direction in accordance with the present embodiment.

As shown in FIG. 6, each cooling roller 40 is provided with a hollow column-shaped drum 41, a column part 41*b* built in a hollow part 41*a* of the drum 41, a rotary joint 42 attached to each of two ends of the drum 41 and an outgoing pipe 42*a* attached to the rotary joint 42 on one end side as well as a return pipe 42*b* attached to the rotary joint 42 on the other end side.

In the cooling roller 40, the hollow part 41*a* of the drum 41, the rotary joints 42 on the two ends and the inside of the outgoing pipe 42*a* and the return pipe 42*b* are communicated with one another.

In the cooling roller 40, cooling water is allowed to flow into the drum 41 through the rotary joints 42.

More specifically, in the cooling roller 40, the cooling water is guided to an outside flow path 41*b*2 of the column part 41*b* of the hollow part 41*a* through the rotary joint 42 on one end side from the return pipe 42*a*, and is allowed to flow from the outside flow path 41*b*2 into a return pipe 42*b* through the rotary joint 42 on the other end side. Thus, the cooling roller 40 can be sufficiently cooled.

In the drying device H in the present embodiment, as described earlier, a wet printed object X immediately after the printing process is heated step by step by using the first heating roller part 10 and the first heating part 11, as well as the second heating roller part 20 and the second heating part 21, which have different setting temperatures; therefore, the printed object X can be positively dried and it also becomes possible to sufficiently suppress curling of the printed object X itself or wrinkles and cockling from occurring in the printed object X.

Moreover, the printed object X is sufficiently cooled by the quick cooling roller 30 and the cooling roller 40; therefore, in the case when the printed object X is collected by winding-up or the like, it becomes possible to suppress the dimensional changes of the printed object X at the time of winding-up as much as possible.

Furthermore, by returning the temperature of the printed object X to the state prior to the drying process, another printing process can be carried out on the rear surface of the printed object.

Next, explanation is given to an ink-jet printing device in accordance with the present invention.

Figure 7:
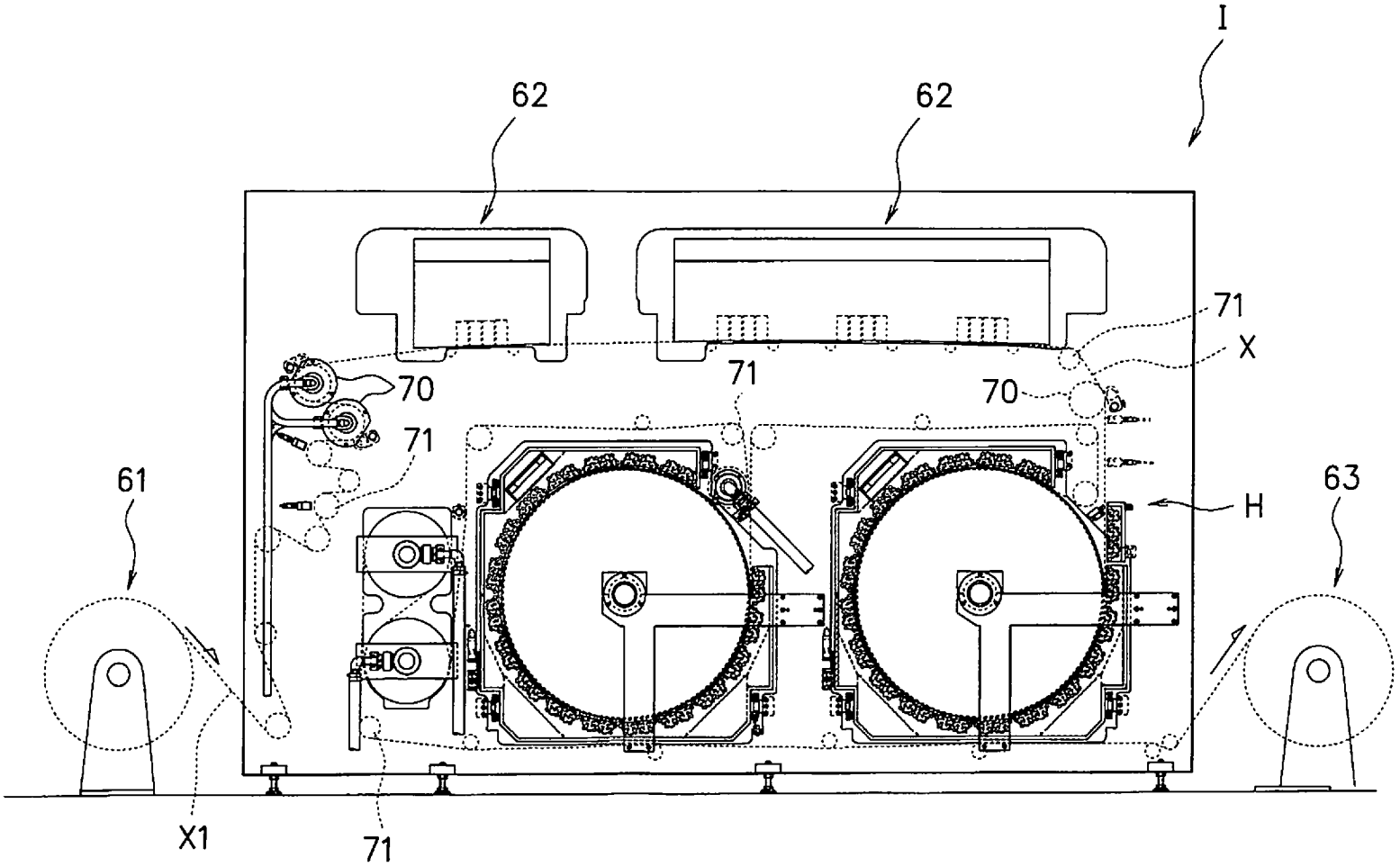
FIG. 7 is a perspective side view schematically showing one embodiment of an ink-jet printing device in accordance with the present invention.

FIG. 7 is a perspective side view showing an embodiment of the ink-jet printing device in accordance with the present invention.

As shown in FIG. 7, an ink-jet printing device I in accordance with the present embodiment is provided with a paper feeding part 61 for supplying a printing object X1, a printing part 62 for printing the printing object X1 while transporting it and a drying device H for drying a long-sized printed object X that has been printed by the printing part 62 while transporting it and a collecting part 63 for collecting the dried printed object X.

In the ink-jet printing device I, the printing part 62 is constituted by a plurality of ink-jet printing heads. Additionally, as the system of the ink-jet printing heads, a line head system or a serial head system may be used.

Moreover, into each of the ink-jet printing heads, the aforementioned ink is filled for each of the colors of YMCK, or the like.

In the ink-jet printing device I, the printed object X is transported at a desired speed by rotating a pull roller 70 by a servo motor, not shown.

Moreover, the tension of the printed object X is detected by a tension roller 71 to which a tension sensor, not shown, using a load cell or the like is attached so that the rotation amount of the pull roller 70 can be adjusted by the servo motor so as to achieve a target tension.

Furthermore, the transporting path of the printed object X below the printing part 62 has an arch shape. Thus, it becomes possible to suppress flapping of the printed object X.

In the ink-jet printing device I, since the above-mentioned drying device H is installed, the printed object X that has been subjected to printing processes by the plural ink-jet printing heads can be dried immediately after the printing processes, the printed object X itself is suppressed from being curled, and it becomes possible to sufficiently suppress wrinkles and cockling from occurring in the printed object X.

Although embodiments of the present invention have been explained above, the present invention is not intended to be limited by the above-mentioned embodiments.

The drying device H of the present embodiment is provided with the auxiliary heating part 50; however, the auxiliary heating part 50 is not necessarily an indispensable component.

In the drying device H in accordance with the present embodiment, the first heating roller part 10 is provided with the hollow column-shaped drum 12, the band heater 13 for heating the drum 12 and the shaft core 16 to which the two sides of the drum 12 are attached and fixed; however, the first heating roller part 10 is not limited by this structure, as long as the outer circumferential surface of the first heating roller part 10 can be heated. Additionally, the same is true for the second heating roller part 20.

In the drying device H in accordance with the present embodiment, the drum 12 of the first heating roller part 10 has its outer circumferential surface subjected to irregularity machining; however, this process is not necessarily required.

Moreover, instead of the irregularity machining, thin grooves may be formed on the surface of the drum 12.

Additionally, the same is true for the drum of the second heating roller part 20.

In the drying device H in accordance with the present embodiment, as the heating part 11, the first hot air blowing devices 14 that are arranged side by side are exemplified; however, the present invention is not intended to be limited by this structure, as long as at least one surface of the printed object X can be heated and dried. Additionally, the same is true for the auxiliary heating part 50 and the second heating part 21.

In the drying device H in accordance with the present embodiment, the first chamber 15 for housing the first heating roller part 10 and the first heating part 11 is not necessarily an indispensable component.

That is because although the chamber is used for enclosing floating aqueous solvent so as to be removed, the setting temperatures of the first heating roller part 10 and the first heating part 11 are not temperatures that positively evaporate the aqueous solvent.

Moreover, for the same reason as described above, in the drying device H, no quick cooling roller to be proximately placed thereto is installed in the first heating roller part 10.

Additionally, in order to positively prevent the aqueous solvent from floating, it is of course possible to install the first chamber 15 and also to install the quick cooling roller proximately located to the first heating roller part 10.

In the drying device H in accordance with the present embodiment, the quick cooling roller 30 is provided with the hollow column-shaped drum 31, the cylinder part 31*b* built in a hollow part 31*a* of the drum 31, the rotary joint 32 attached to one end of the drum 31 and the outgoing pipe 32*a* as well as the return pipe 32*b* attached to the rotary joint 32; however, the present invention is not intended to be limited by this structure as long as the printed object X can be cooled.

In the drying device H in accordance with the present embodiment, the cooling roller 40 is provided with the hollow column-shaped drum 41, the column part 41*b* built in a hollow part 41*a* of the drum 41, the rotary joint 42 attached to each end of the drum 41 and the outgoing pipe 42*a* attached to the rotary joint 42 on one end side as well as the return pipe 42*b* attached to the rotary joint 42 on the other end side; however, the present invention is not intended to be limited by this structure as long as the printed object X can be cooled.

INDUSTRIAL APPLICABILITY

The drying device of the present invention can be utilized as a device in which while transporting a long-sized printed object that is formed by applying an ink onto a printing object in a printing part of a printing device, the printed object is dried. In accordance with the drying device, the printed object can be dried, and it becomes possible to sufficiently suppress curling of the printed object itself or wrinkles and cockling from occurring in the printed object.

The ink-jet printing device of the present invention can be utilized as a device in which by applying an ink to a printing object, characters and patterns can be printed thereon. In accordance with the ink-jet printing device, since the printing device is provided with the above-mentioned drying device, the printed object can be dried, and it becomes possible to sufficiently suppress curling of the printed object itself or wrinkles and cockling from occurring in the printed object.

REFERENCE SIGNS LIST

10 . . . first heating roller part (heating roller part),
11 . . . first heating part (heating part),
12, 31, 41 . . . drum,
13 . . . band heater,
13*a* . . . power source terminal,
13*b* . . . thermocouple,
13*c* . . . thermostat,
14 . . . first hot air blowing device (hot air blowing device),
14*a* . . . blowing unit,
14*a*1 . . . sheath heater,
14*a*2 . . . nozzle pipe,
14*a*3 . . . heater cover,
14*a*4 . . . bottom plate,
15 . . . first chamber (chamber),
15*a* . . . exhaust opening,
16 . . . shaft core,
16*a* . . . power source-use rotary connector,
16*b* . . . signal-use rotary connector,
20 . . . second heating roller part (heating roller part),
21 . . . second heating part (heating part),
24 . . . second hot air blowing device (hot air blowing device),

25 . . . second chamber (chamber),
30 . . . quick cooling roller,
31, 41 . . . drum,
31*a*, 41*a* . . . hollow part,
31*b* . . . cylinder part,
31*b*1 . . . inside flow path,
31*b*2, 41*b*2 . . . outside flow path,
32, 42 . . . rotary joint,
32*a*, 42*a* . . . outgoing pipe,
32*b*, 42*b* . . . return pipe,
40 . . . cooling roller,
41*b* . . . column part,
50 . . . auxiliary heating part,
51 . . . auxiliary hot air blowing device,
61 . . . paper feeding part,
62 . . . printing part,
63 . . . collecting part,
70 . . . pull roller,
71 . . . tension roller,
B1, B2 . . . bracket,
D1 . . . exhaust-use air blower,
D2 . . . supply-use air blower,
F1 . . . frame,
H . . . drying device,
HA . . . box part,
H1 . . . shortest distance,
H2 . . . width,
I . . . ink-jet printing device,
K . . . cut-out part,
L . . . rail part,
N . . . nozzle part,
P . . . slide part,
R . . . rib part,
S . . . slit,
T . . . gap,
X . . . printed object,
X1 . . . printing object

The invention claimed is:

1. A drying device wherein, while transporting a long-sized printed object to which an ink was applied by a printing part, the printed object is dried, the drying device comprising:

a first heating roller part and a second heating roller part capable of guiding the printed object and heating the printed object;

a first heating part formed so as to be opposed to an outer circumferential surface of the first heating roller part; and a second heating part formed so as to be opposed to an outer circumferential surface of the second heating roller part, wherein after the printed object has been guided to the first heating roller part on an upstream side, the printed object is guided to the second heating roller part on a downstream side, with the setting temperature of the second heating roller part being made higher than a setting temperature of the first heating roller part.

2. The drying device according to claim 1, wherein the first heating part is constituted by a plurality of first hot air blowing devices that are installed side by side along a circumferential direction of the first heating roller part and the second heating part is constituted by a plurality of second hot air blowing devices that are installed side by side along a circumferential direction of the second heating roller part, and wherein gaps are formed between a printing surface of the printed object and the first hot air blowing devices as well as between the printing surface of the printed object and the second hot air blowing devices so that the first hot air blowing devices and the second hot air blowing devices are respectively capable of blowing hot air toward the printing surface of the printed object.

3. The drying device according to claim 2, wherein a gap is formed between the mutually adjacent first hot air blowing devices and a gap is formed between the mutually adjacent second hot air blowing devices.

4. The drying device according to claim 1, further comprising:

an auxiliary heating part that is installed on the upstream side other than a position at which a rear surface of the printed object is made to contact with the first heating roller part, wherein the auxiliary heating part is constituted by auxiliary hot air blowing devices installed along a transporting path of the printed object, with a gap being formed between a printing surface of the printed object and the auxiliary hot air blowing device, so that the auxiliary hot air blowing devices are capable of blowing the hot air toward the printing surface of the printed object.

5. The drying device according to claim 1, wherein the second heating roller part and the second heating part are housed in a chamber provided with an exhaust opening.

6. The drying device according to claim 5, further comprising:

a quick cooling roller that guides the printed object and is also capable of cooling the printed object, wherein the quick cooling roller is disposed closely to the second heating roller part so that the printed object ejected out of the chamber is directly guided from the second heating roller part to the quick cooling roller.

7. The drying device according to claim 6, further comprising:

a cooling roller that guides the printed object and is also capable of cooling the printed object, wherein the cooling roller is disposed on the downstream side of the quick cooling roller so that after the printed object has been guided to the quick cooling roller, the printed object is further guided to the cooling roller.

8. An ink-jet printing device comprising:

a printing part which, while transporting a printing object, carries out a printing process on the printing object, and the drying device according to claim 1 which, while transporting the long-sized printed object that was printed by the printing part, dries the printed object, wherein the printing part is constituted a plurality of ink-jet printing heads.

* * * * *